United States Patent [19]

Winn

[11] 4,171,052

[45] Oct. 16, 1979

[54] MERCHANDISE DISPLAY UNIT

[75] Inventor: Ronald R. Winn, Galesville, Wis.

[73] Assignee: Ernest Kempler, Chicago, Ill. ; a part interest

[21] Appl. No.: 720,922

[22] Filed: Sep. 7, 1976

[51] Int. Cl.[2] ..... A47F 5/00; A47B 57/16

[52] U.S. Cl. ..... 211/162; 211/175; 211/208; 248/243

[58] Field of Search ..... 211/94, 94.5, 162, 175, 211/184, 180, 182, 193; 312/342, 262, 345, 122, 132; 49/410, 411, 413, 460; 248/243; 108/152

[56] References Cited

U.S. PATENT DOCUMENTS

| | | | |
|---|---|---|---|
| 1,693,980 | 12/1928 | Gale | 312/132 X |
| 2,547,368 | 4/1951 | Booth | 211/46 X |
| 3,353,684 | 11/1967 | Chesley | 108/106 X |
| 3,750,893 | 8/1973 | Kempler | 211/162 |
| 3,883,004 | 5/1975 | Slaga | 211/162 |
| 3,912,086 | 10/1975 | de Bruyn | 211/162 |

*Primary Examiner*—Thomas J. Holko
*Attorney, Agent, or Firm*—Wheeler, Morsell, House & Fuller

[57] ABSTRACT

A headboard and footboard are removably attached to a vertical multiply-slotted standard by means of keys to form a display unit. (These standards may be part of the display structure already mounted in a store). A number of panels are slideably mounted for independent travel back and forth within the confines of the headboard and footboard to reveal merchandise hung on the panels for display in a store. Means are provided to support the panels from the bottom, so that the sides and top of the display do not bear much weight. The panels and associated hardware can be individually moved forward or backward within the display to allow more or less space between two panels or to accommodate additional panels. When the panels are in the desired positions, they can be locked to prevent unwanted forward and back travel, but to allow panels to slide from side to side.

Improved keys are utilized which lock to vertical standards. One of these improved keys also adapts to fit vertical standards having variously spaced perforations, and both keys have means to lock to a standard so that they will not come loose accidentally. These keys are adapted to allow adjustment of the depth of the display unit by varying the depth of insertion of the keys in the side members of the headboard and footboard.

22 Claims, 8 Drawing Figures

MERCHANDISE DISPLAY UNIT

SUMMARY OF THE INVENTION

This invention is an improved display cabinet of the type having several sliding panels on which small items of merchandise are hung. The panels are commonly made of pegboard to facilitate such display.

Several features of this invention distinguish it from other display units known to the art. (The closest known prior art is Slaga, U.S. Pat. No. 3,883,004.)

First, the panel hardware is constructed such that any sliding display panel may be adjusted forward or backward with respect to the standard to accommodate merchandise of various sizes and to allow additional panels to be introduced. (Extra sets of hardware may be provided within the unit to accommodate additional panels.) This is an advantage compared to known display units, which provide several fixed slots, holes, or other discrete attachment points, for in this invention the display panels may be adjusted infinites imally.

In addition, means are provided to positively lock the display panel hardware to the frame of this unit so that the panels will remain in constant alignment except when adjustment is desired. Thus, this invention is more adaptable than known units, and any number of panels that the unit can accommodate can be uniformly spaced and firmly attached.

Second, since the headboard and footboard are each connected to multiply-slotted vertical standards or known construction, display panels of any height may be used, and the entire display may be raised and lowered to adjust the height at which merchandise is displayed.

Third, unlike many display units of this type, the panels are supported by the bottom, rolling on a system of ball bearings. This means that the back wall and the top of the unit do not have to bear the entire weight of the merchandise and display panels, so the display unit may be made largely of light material without using a design in which the side view is obstructed, or in which unsightly posts interfere with the open lines of the display.

Fourth, one embodiment of this display unit is adapted to be installed on vertical standards, or their equivalent, already mounted on the walls or aisles of a store. Thus, remodeling costs to install this equipment are often low, and the price of the display unit may be kept lower than that of competing units.

Fifth, this display unit is relatively simple to build. The headboard or footboard may be formed from a single extrusion, and the vertical standards and conventional keys may be obtained commercially. Most of the hardware is easily fabricated.

Sixth, two improved keys for use with this invention are disclosed herein. In both new embodiments means are provided to positively lock the keys to the vertical standards, so the display unit cannot accidentally come apart, yet adjustment is simple. One key may be adjusted to adapt to vertical standards with variously-spaced perforations so that a single key fits many standards. The keys have bodies which are slideably mounted within the side members of the headboard and footboard, and several sets of mounting holes are spaced along the key bodies so that the depth of the display unit may be adjusted.

REFERENCES TO FIGURES

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

Figure 1:
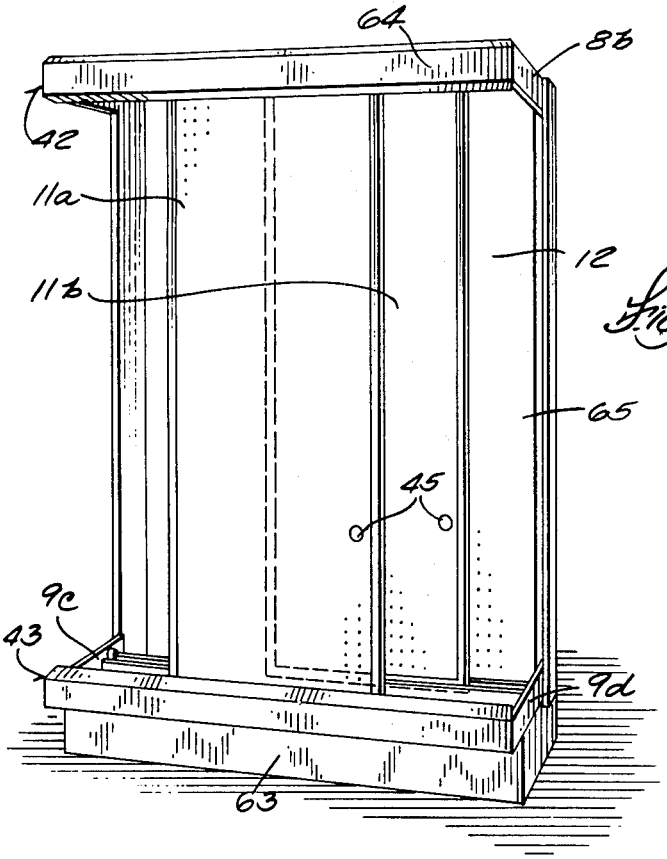
FIG. 1 is a front perspective view of a free-standing display unit.

FIG. 1 shows one embodiment of the invention—a free-standing display unit comprising headboard 42 and footboard 43 attached to vertically disposed standard 12. Display panels 11*a*, 11*b*, etc., slide back and forth to reveal the contents displayed on panels behind them, while fixed display panel 65, which extends over the entire space between standards 12, may be added to provide a uniform back display wall. These free-standing units may be aligned side-by-side in a known way to form a continuous display.

Figure 2:
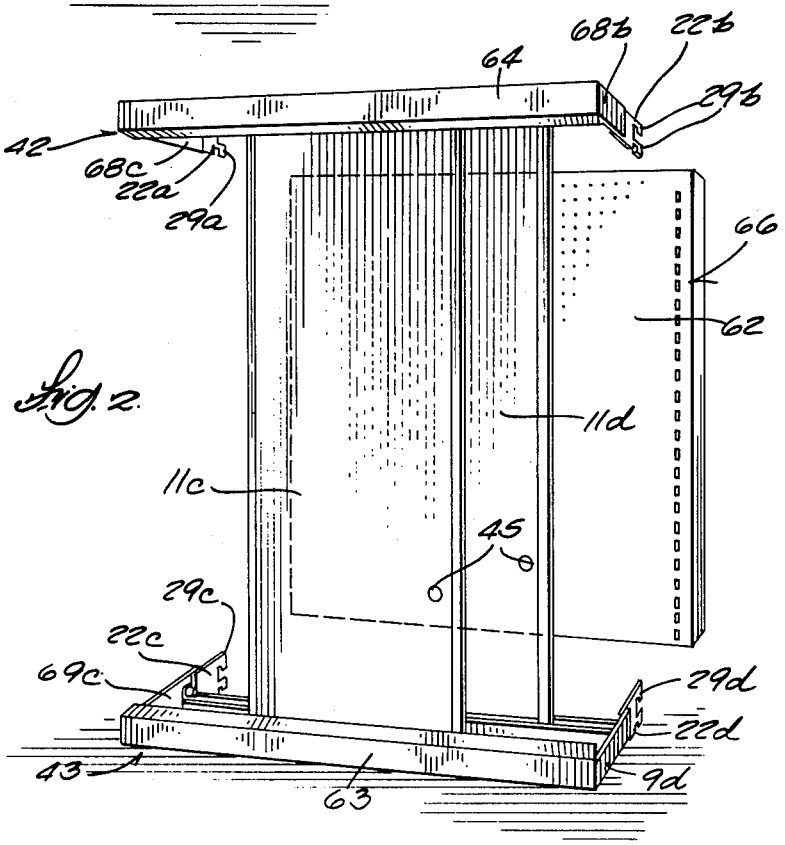
FIG. 2 is a front perspective exploded view of a headboard, a footboard, and display panels adapted to attach to existing vertical standards mounted on the wall of a store.

In FIG. 2 another embodiment of the invention is shown, in which headboard 42 and footboard 43 are adapted to attach to standard means 66, commonly found on display walls 62, built into stores to serve display functions. The headboard 42 and footboard 43 can be attached to different perforations of standard means 66 to accommodate panels of various sizes and to put the entire display at various viewing heights. Keys 22*a–d* can be adapted to fit into any type of vertically arrayed perforations, as will be described below.

Figure 3:
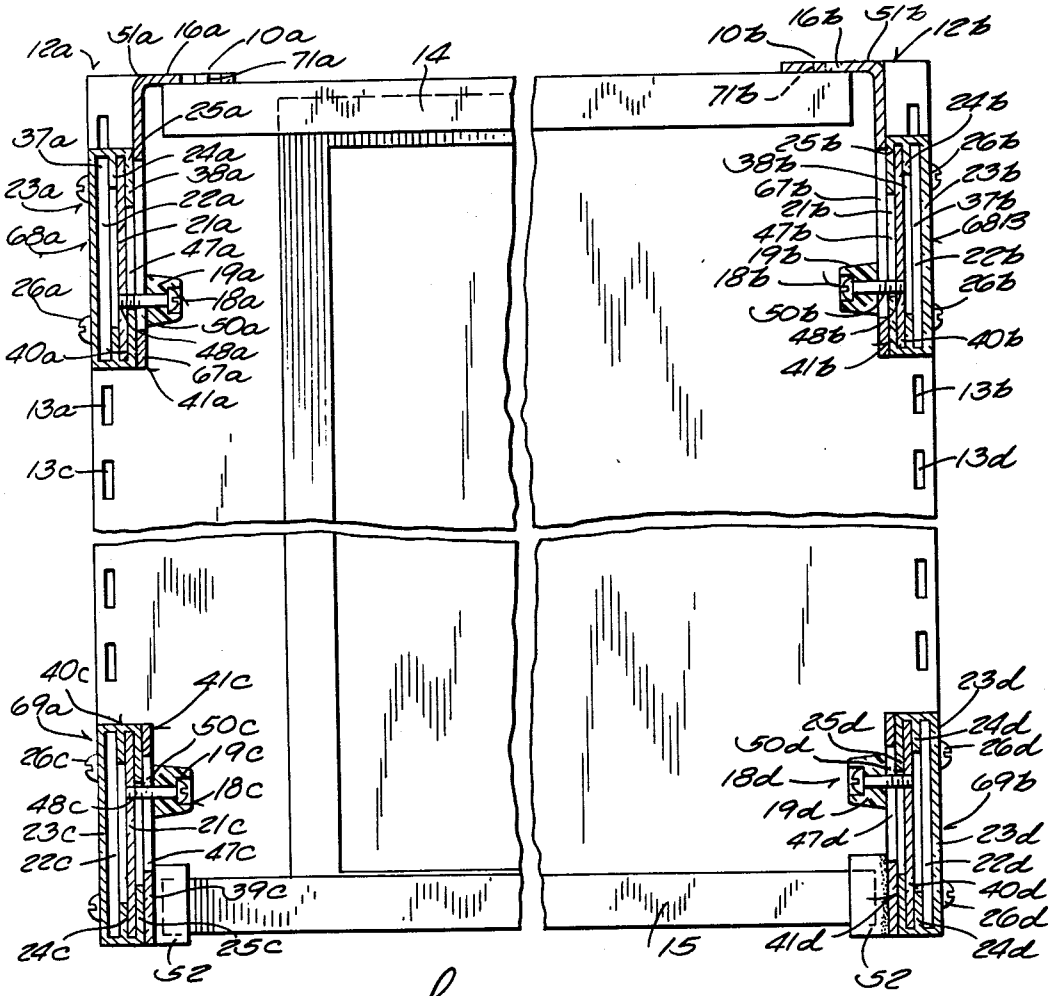
FIG. 3 is a front cross-sectional view of the display unit, showing how the panel top guide means and the panel bottom guide and support means are attached to the side members of the headboard and footboard.
Figure 7:
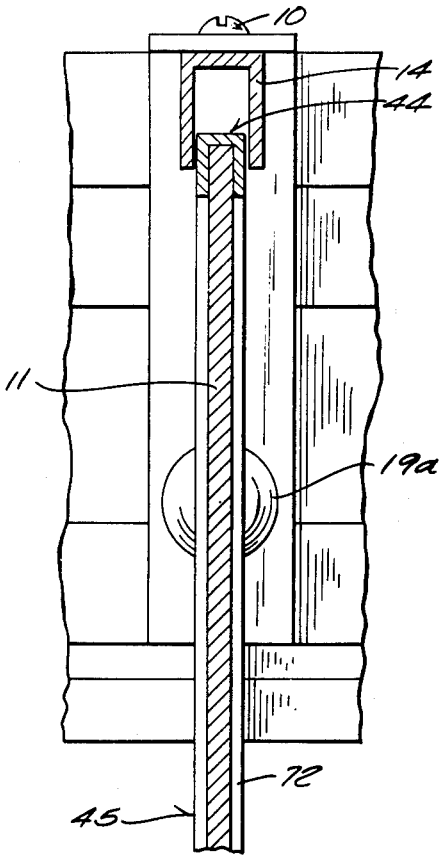
FIG. 7 is a fragmentary cross-sectional top view of a side member showing the relation of the locking plate and the key to the side members and to each other.
Figure 7:
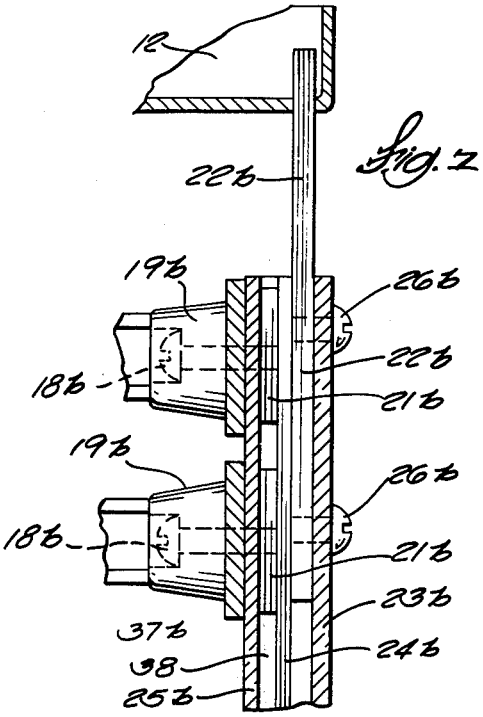

FIGS. 3 and 7 reveal the basic structure of side members 68*a* and 68*b* of the headboard and side members 69*a* and 69*b* of the footboard. In the headboard, side members 68*a* and *b*, which are formed from unitary extruded shape in this embodiment, each have an outer wall 23*a* and *b*, a middle wall 24*a* and *b*, and an inner wall 25*a* and *b*. Inner walls 25*a* and *b* each have an inside face 41*a* and *b* and an outside face 40*a* and *b*. Between walls 23*a* and *b* and 24*a* and *b* outside channels 37*a* and *b* are formed. In the wall-mounted embodiment the rear part of this channel contains keys 22*a–d* which are locked to side members 68*a* and *b* by screws 26*a* and *b* passing through outer walls 23*a* and *b*. Between walls 24*a* and *b* 25*a* and *b* inside channels 38*a* and *b* are formed; inside channels 38*a* and *b* contain locking plates 21*a* and *b* which are free to slide back and forth in the confines of inside channels 38*a* and *b*.

Figure 8:
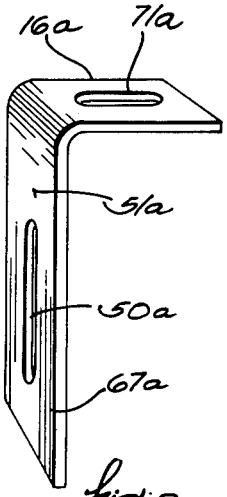
FIG. 8 is a perspective view of a mounting bracket for the top panel guide means showing the openings therein.

Panel top guide means 14 is rigidly connected to horizontal members 16*a* and *b* of top mounting brackets 51*a* and *b* by screws 10*a* and *b* which pass through openings 71*a* and *b* (see FIG. 8) in said horizontal members 16*a* and *b*. In the preferred embodiment, said openings 71*a* and *b* have a long transverse dimension to accommodate panel top guide means of various lengths. Vertical members 67*a* and *b* of top mounting brackets 51*a* and *b* have unthreaded openings 50*a* and *b* (see FIG. 8), which in this embodiment have a relatively long vertical dimension so that small adjustments can be made in the height of panel top guide means 14 without moving key 22.

Immediately adjacent to openings 50*a* and *b* are horizontal slots 47*a* and *b* which communicate between inside faces 41*a* and *b* and outside faces 40*a* and *b* along substantially the entire depth of inner walls 25*a* and *b*.

Locking plates 21*a* and *b* have threaded holes immediately adjacent to horizontal slots 47*a* and *b* no matter where in the confines of inside channels 38*a* and *b* locking plates 21*a* and *b* happen to be. Locking screws 18*a* and *b* pass first through resilient bumpers 19*a* and *b* then through unthreaded openings 50*a* and *b*, then through horizontal slots 47*a* and *b*, then into threaded holes 48*a* and *b* in locking plates 21*a* and *b*. When locking screws 18*a* and *b* are loose, panel top guide means 14 may be moved forward and back so that locking plates 21*a* and *b* slide within inside channels 38*a* and *b*. (It is useful to put marking or decals on the side members so that the several sets of hardware for each panel may be properly aligned.) As explained above, panel top guide means 14 may also be moved up and down at this time. However, when locking screws 18*a* and *b* are tightened, vertical members 67*a* and *b* of top mounting brackets 51*a* and *b* bear against inside faces 41*a* and *b* of inner walls 25*a* and *b* and locking plates 21*a* and *b* bear against outside faces 40*a* and *b* of inner wall 25*a* and *b*. As a result, both horizontal and vertical movement of panel top guide means 14 is precluded unless locking screws 18*a* and *b* are loosened.

Construction of the footboards 69*a* and *b* is entirely analogous to the above, except that panel top guide means 14 is replaced by panel bottom guide and support means 15, and top mounting bracket 51 is replaced by bottom mounting brackets 52.

In either embodiment headboard 42 or footboard 43 may conveniently be formed by extruding a shape with a cross-section identical to that of a side member 68 or 69. This shape is then notched, bent and reinforced in a conventional fashion to form the completed headboard 42 or footboard 43.

Figure 6:
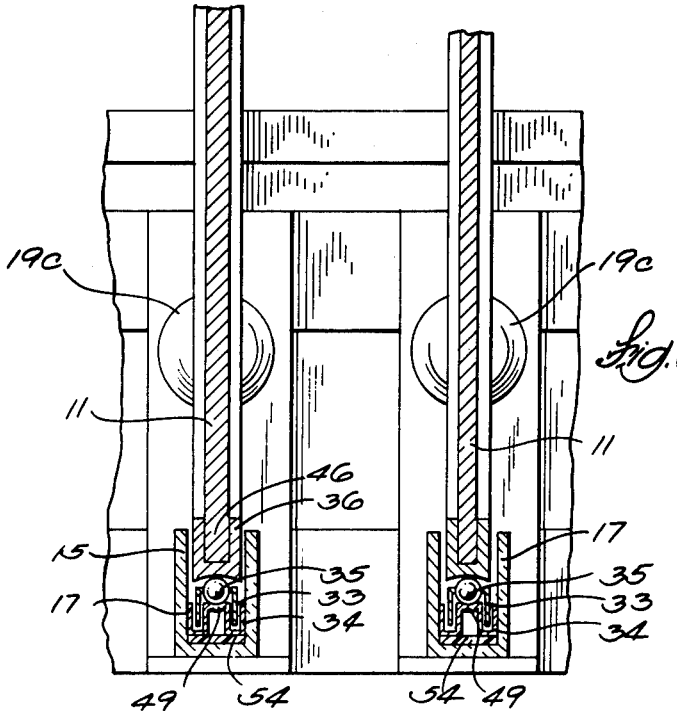
FIG. 6 is a fragmentary longitudinal sectional view of a display unit showing a cross-sectional view of the top panel guide means, and showing the relation of two panels to each other in a single display unit.

Referring now to FIG. 6, which shows a side view of the sliding display panels 11 sliding panel 11 is held by panel top guide means 14—which receives panel top edge 44—and by panel bottom guide and support means 15—which receives panel bottom edge 46—so that forward face 45 or panel 11 remains in a transverse vertical plane. Rigid side supports 72 on each display panel prevent the panel from bending and provide a convenient handhold with which to move the sliding panels.

Panel top guide means 14 is simply a channel which is shaped like an inverted "U".

Panel bottom guide and support means 15 contains ball bearing carrier guide 34, which has a concave upward-facing central track 49 on which ball bearings 35 roll. Ball bearing carrier guide 34 is cushioned along its length by rubber pad 54. Ball bearings 35 are loosely contained by ball bearing carrier 33, which overlies central track 49, in order to maintain the regular spacing of ball bearings 35. Ball bearing carrier 33 is constructed to allow ball bearings 35 to touch panel shoe 36. Panel shoe 36 has a lower edge which is slightly rounded to receive ball bearings 35; it also has an upward facing channel adapted to receive bottom edge 46 of panel 11.

As shown in FIGS. 1, 2, 6 and 7, more than one display panel 11 and associated sliding hardware may be mounted in a single display unit. The number of display panels 11 is limited only by the number of locking plates 21 which will fit within inside channels 38. (Of course, the more locking plates one introduces into inside channel 38, the less room is available for sliding adjustment of display panels.)

Panels may easily be removed from the display unit by loosening screws 18, lifting panel top guide means 14 to allow room between said guide 14 and panel top edge 44, lifting the panel so that bottom edge 46 is clear of panel shoe 36, and lowering the panel diagonally to bring top edge 44 clear of said guide means 14.

Figure 4:
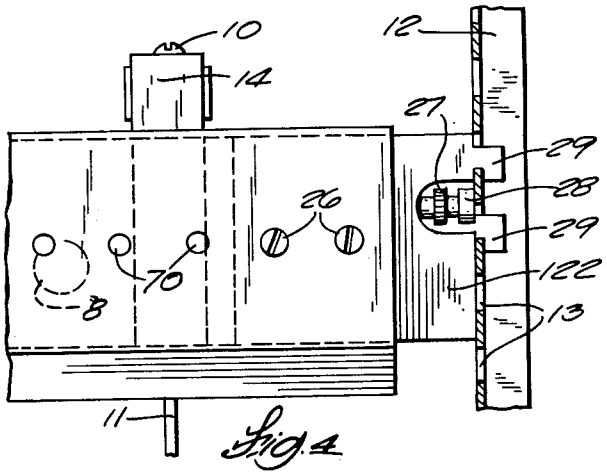
FIG. 4 is an fragmentary side view of the headboard or footboard depicted a key which locks to the vertical standard by means of a setscrew, and showing how the key may be attached to the side members.

FIG. 4 shows one embodiment of an improved key adapted for use with this invention. (Conventional keys may also be used.) Dentate portions 29 are designed to fit through adjacent perforations 13 in vertically disposed standard 12, in a known way. Setscrew mount 28 is attached to key body 122 adjacent to the perforated surface of said standard 12. Setscrew 27, which is threadably mounted in setscrew mount 28, may be advanced to bear against said standard 12 so that the key cannot be removed from perforations 13.

Figure 5:
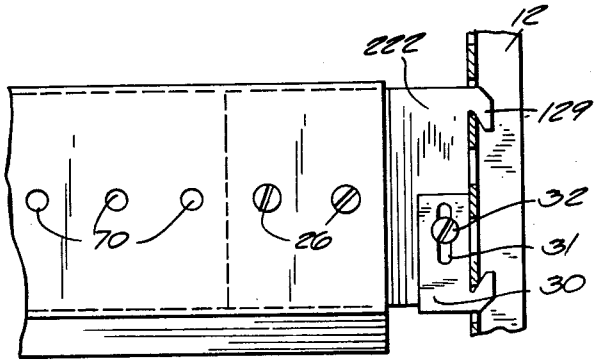
FIG. 5 is an fragmentary side view of the headboard or footboard showing an alternate key with fixed and movable dentate portions which may be secured to a vertical standard and locked into place.

FIG. 5 depicts a second improved key. In this embodiment, dentate portion 129 is fixed with respect to key body 222, and dentate portion 30 is movable with respect to key body 222. Screw 32, passing through vertically disposed slot 31, brings movable dentate portion 30 into sliding contact with key body 222 when said screw 32 is loose. When screw 32 is tightened, movable dentate portion 30 becomes fixed with respect to key body 222 and fixed dentate portion 129.

This relation between fixed dentate portion 129 and movable dentate portion 30 has two purposes. First, the key may be adapted to fit a wide variety of vertically disposed standards with differently spaced openings. Second, the key may be locked onto a vertically disposed standard by moving movable dentate portion 30 so that the key cannot be removed, then by tightening screw 32 to fix movable dentate portion 30 in place. This prevents the key from disengaging accidentally.

In both improved keys, several key mounting holes 70 are provided. This allows the keys to be attached to the side members at various depths of insertion so that the depth of the display unit may be varied.

The word "transverse" where it appears in the description and claims hereof means a horizontal direction parallel to a line extending from one side support to the other, and side support means a standard (12 or 66) or any member including equivalent well-known slots 13 (FIG. 3). Thus the three mutually perpendicular axes or directions of my device are vertical or up and down, the horizontal front and back direction, and the horizontal transverse or side to side direction.

I claim:

1. A display unit comprising a headboard; a footboard; at least two vertically disposed standards, with multiple regularly spaced openings, to which the headboard and footboard are attached by keys; at least one display panel with a top edge, a bottom edge and a forward face, which panel is slideably mounted to travel sideways within the confines of the headboard and footboard with its forward face always lying in a transverse vertical plane; panel top guide means for each display panel which mount separately in said headboard; and panel bottom guide and support means for each display panel which mount separately in said footboard; the improvement comprising means to slideably adjust individual panel top guide means and associated panel bottom guide and support means in a direction normal to the forward face of the display panel associated with said panel top guide means and said panel bottom guide and support means, whereby said display panel can be positioned with its forward face in any transverse vertical plane lying within its limits of travel, defined by the confines of the headboard and footboard.

2. The display unit of claim 1, said headboard having a forward member and left and right side members, and each side member having an outside wall, a middle wall, and an inside wall which is pierced by a horizontal slot, said walls defining inside and outside channels parallel to said slot and perpendicular to a transverse vertical plane.

3. The display unit of claim 2, and further comprising one pair of left and right locking plates slideably mounted in the inside channel of said left and right headboard side members and attached to the opposite ends of each panel top guide means to allow sliding adjustment of said top guide means.

4. The display unit of claim 2 in which the inside wall of each member has inner and outer faces; a locking plate resting against said outer face and having a threaded hole adjacent to the slot in said inside wall; a top mounting bracket with vertical and horizontal members attached by its horizontal member to each end of each panel top guide means; the vertical member of said bracket resting against said inner face; said vertical member having an unthreaded opening adjacent to the slot in said inner wall and aligned with the threaded hole in the locking plate; and a locking screw passing through the unthreaded opening in the vertical member of the top mounting bracket, then through the slot in the inside wall of the side member, then into the threaded hole in the locking plate; whereby advancement of the locking screw into the threaded hole of the locking plate causes the locking plate to bear against the outer face of the inner wall of each side member and causes the vertical members of said bracket to bear against the inner face of said inner wall so that the end of the panel guide means is temporarily locked in place.

5. The display unit of claim 4, in which said locking screw passes through a resilient bumper having a countersunk hole before passing through said vertical slot, whereby the impact of display panels which have traveled to the end of said panel top guide means in cushioned.

6. The display unit in claim 4, in which the unthreaded opening in the vertical member of each top mounting bracket is a vertically disposed slot, whereby vertical adjustment of the top panel guide means can be accomplished by loosening the locking screws, moving the left and right mounting brackets up or down, then advancing the locking screws or down, then advancing the locking screws to lock the top panel guide means in place.

7. The display unit of claim 2, and further comprising at least one dentate portion on each key which is inserted into an opening in one said vertical standard and locked thereto, and key bodies which are slideably received in the respective outside channels of said left and right side members to lock the headboard to the vertically disposed standards.

8. The display unit of claim 7 in which said keys each have at least one fixed dentate portion, at least one movable dentate portion, and means to lock the movable portion to the key body, whereby said keys may be locked to a vertical standard with multiple perforations by inserting the fixed and movable dentate portions through corresponding openings in the vertical standards, by moving the movable dentate portion with respect to the fixed dentate portion, and by locking the mocable dentate portion to the key body.

9. The display unit of claim 7 and further comprising setscrew mount with a threaded hole in said keys through which a setscrew is advanced to bear against the vertical standard to lock said keys in place.

10. The display unit of claim 2, in which said left and right side members are extruded bodies.

11. The display unit of claim 10, in which the left, right, and forward members of the headboard are all formed from a unitary extruded body.

12. The display unit of claim 1 in which said footboard has a forward member; left and right members each having an outside wall, a middle wall, and an inside wall which is pierced by a horizontal slot, said walls defining inside and outside channels parallel to said slot and perpendicular to a transverse vertical plane.

13. The device of claim 12, and further comprising one pair of left and right locking plates slideably mounted in the inside channels of said left and right footboard side members and attached to the opposite ends of each panel bottom guide and support means, to allow sliding adjustment of said panel bottom guide and support means.

14. The display unit of claim 13, in which the inside wall of each side member has inner and outer faces; a locking plate resting agasinst said outer face and having a threaded hole adjacent to the slot in said inside wall; a bottom mounting bracket with vertical and horizontal members attached by its horizontal member to each end of the panel bottom guide and support means; the vertical member of said bracket resting against said inner face; said vertical member having an unthreaded perforation adjacent to the slot perforating said inner wall and being aligned with the threaded hole in the locking plate; and a locking screw passing through the unthreaded perforation in the vertical member of the bottom mounting bracket, then through the slot in the inside wall of the side member, then into the threaded hole in the locking plate; whereby advancement of the locking screw into the threaded hole of the locking plate causes the locking plate to bear against the outer face of the inner wall of each side member and causes the vertical member of said bracket to bear against the inner face of said inner wall so that the end of the panel bottom guide and support means is temporarily locked in place.

15. The display unit of claim 14, in which said locking screw first passes through a resilient bumper with a countersunk hole, whereby the impact of display panels which have traveled to the end of the panel bottom guide and support means is cushioned.

16. The device in claim 12, in which each key has at least one dentate portion to be inserted into a perforation in one said vertical standard and locked thereto, and in which the key bodies are slideably received in the respective outside channels of said left and right side members to lock the footboard to the vertically disposed standards.

17. The display unit of claim 16, in which said left and right side members are extruded bodies.

18. The display unit of claim 16, in which the left, right, and forward members of the footboard are all formed from a unitary extruded body.

19. The display unit of claim 1, in which said top panel guide means is a channel with a cross-sectional shape resembling an inverted "U", dimensioned to receive the top edge of the display panel.

20. The display unit of claim 1, in which said bottom panel guide and support means consists of a transverse ball bearing carrier guide having a concave upward-facing central track; a ball bearing carrier which rides transversely over said central track; a multiplicity of ball bearings mounted in a transverse horizontal line along the ball bearing carrier; and a panel shoe having a lower edge that rides over said ball bearings and having a upward-facing channel adapted to receive the bottom edge of said display panel.

21. A rack of one or more movable display units comprising:

(A) an upper frame structure having a pair of spaced upper forwardly horizontally extending side pieces;

(B) upper attaching means connected to said upper side pieces for securing the rear end portion of said upper side pieces to a rear vertical support structure, said upper side pieces including lockable adjusting means for progressively changing the length thereof;

(C) a lower frame structure having a pair of spaced lower forwardly horizontally extending side pieces, and said lower side pieces including lockable adjusting means for progressively changing the length thereof;

(D) lower attaching means connected to said lower side pieces for securing the rear end portions thereof to said vertical support structure below said upper frame structure;

(E) at least one movable display unit for removably supporting merchandise on the front thereof and each having a width which is much less than the width of the rack and one other display unit positioned behind said at least one movable display unit;

(F) upper guide means for guiding the motion of the top portion of each movable display unit to a predetermined path parallel to the front of the rack;

(G) upper coupling means attached to said side pieces of said upper frame structure for connecting said upper guide means to said upper side pieces of said upper frame structure;

(H) lower guide means for guiding the motion of the bottom portion of a display unit in a predetermined path parallel to the front of the rack; and (I) lower coupling means attached to said lower side pieces of said lower frame structure for receiving and positioning the ends of said lower guide means at fixed distances from said vertical support structure.

22. A rack of sliding display units comprising: a rear vertical frame structure; an upper frame structure; a lower frame structure; said upper and lower frame structures each including a pair of horizontal side pieces on opposite sides of the rack, said side pieces extending forwardly from said rear vertical frame structure, each side piece being adjustable in length to vary the depth of the rack, the front portions of said side pieces being unconnected by any vertical member extending therebetween; at least two movable display units for removably supporting merchandise on the front thereof and each having a width which is much less than the width of the rack; upper guide means for each movable display unit for guiding the top portion of the same in a predetermined path parallel to the front of the rack where access to a desired display unit is obtained by moving each movable display unit in front of the desired unit to one side thereof; lower guide means for guiding the bottom portion of each movable display unit in a predetermined path corresponding to that followed by the upper portion of the same; a separate coupling means for receiving each end of the upper and lower guide means, each coupling means being carried by the adjacent adjustable length side piece of the adjacent frame structure and being separately horizontally and lockably adjustable in position thereon in a front to rear direction of the rack, so that the position of the guide means received by each coupling means and each associated display unit guided thereby is adjustable in position in a front to rear direction on the rack to accomodate merchandise of different sizes carried thereby; and a base for the rack below said lower frame structure and carrying all the weight of said display units, at least said upper frame structure carrying none of the weight of the display units.

* * * * *